US006597324B2

(12) United States Patent
Eriksson

(10) Patent No.: US 6,597,324 B2
(45) Date of Patent: Jul. 22, 2003

(54) SINGLE PIECE ELEMENT FOR A DUAL POLARIZED ANTENNA

(75) Inventor: Stefan G Eriksson, Kalmar (SE)

(73) Assignee: Radiovector U.S.A. LLC, Rockford, IL (US)

( * ) Notice: Subject to any disclaimer, the term of this patent is extended or adjusted under 35 U.S.C. 154(b) by 0 days.

(21) Appl. No.: 09/848,650

(22) Filed: May 3, 2001

(65) Prior Publication Data

US 2002/0163476 A1 Nov. 7, 2002

(51) Int. Cl.[7] ..... H01Q 21/26

(52) U.S. Cl. ..... 343/795; 343/797; 343/815; 343/817; 343/818

(58) Field of Search ..... 343/797, 795, 343/789, 814–820; H01Q 1/38, 21/00, 21/06, 21/26

(56) References Cited

U.S. PATENT DOCUMENTS

| | | | | |
|---|---|---|---|---|
| 2,978,703 A | | 4/1961 | Kuechen | 343/803 |
| 4,498,085 A | | 2/1985 | Schwarzmann | 343/795 |
| 5,418,545 A | | 5/1995 | Pantsios et al. | 343/795 |
| 5,481,272 A | * | 1/1996 | Yarsunas | 343/797 |
| 5,532,707 A | | 7/1996 | Klinger et al. | 343/793 |
| 5,724,051 A | | 3/1998 | Mailandt et al. | 343/795 |
| 5,909,195 A | | 6/1999 | Merenda | 343/815 |
| 5,936,590 A | | 8/1999 | Funder | 343/795 |
| 6,005,522 A | | 12/1999 | Arias et al. | 343/700 |
| 6,020,861 A | | 2/2000 | Jonsson et al. | 343/800 |
| 6,028,563 A | * | 2/2000 | Higgins | 343/797 |
| 6,034,649 A | | 3/2000 | Wilson et al. | 343/795 |
| 6,072,439 A | * | 6/2000 | Ippolito et al. | 343/797 |
| 6,229,496 B1 | | 5/2001 | Eriksson | 343/795 |

* cited by examiner

*Primary Examiner*—Michael C. Wimer
(74) *Attorney, Agent, or Firm*—Leydig, Voit & Mayer Ltd.

(57) ABSTRACT

An antenna system comprising a plurality of dipole elements formed from a single piece of material. The plurality of dipole elements is attached to a reflector plate with a single supporting base and forms horizontally or vertically stacked radiation elements. Tabs located between the center of the single piece and legs of the dipole elements and are bent at an angle to form a symmetrical axis in the center of slots separating the plurality of dipole elements to attenuate the radiation caused by current flowing around the slots. The plurality of dipole elements are selected to achieve different radiation patterns and can be formed into different shapes to achieve different lobe shapes.

20 Claims, 16 Drawing Sheets

SINGLE PIECE ELEMENT FOR A DUAL POLARIZED ANTENNA

FIELD OF THE INVENTION

This invention relates generally to antenna systems and, more particularly, relates to broadband antennas.

BACKGROUND OF THE INVENTION

Broadband antennas used in wireless telecommunication systems are designed to receive or transmit linear polarized electromagnetic signals. The sense or direction of linear polarization is measured from a fixed axis and can range from horizontal polarization (90 degrees) to vertical polarization (0 degrees). Many broadband antennas are designed to employ dipole elements to receive or transmit the signals. These elements are mounted above an artificial ground plane, which is typically an electrically conducting plate, and the elements are connected together via feed lines. These feed lines are often in the form of coaxial cable.

One subset of broadband antennas consists of two dipoles and two feed lines that form a polarized antenna. The polarized antenna can be a dual polarized antenna, consisting of a horizontally polarized portion and a vertically polarized portion. It can also be a ±45 degrees polarized antenna with the proper orientation.

The dipole elements are typically made from multiple pieces and soldered or welded together. As the number of dipole elements is increased, the manufacture of the antenna increases in complexity, time-consumption, and expense. For high frequency operation, the expense increases further due to the tolerances required for operation in the desired frequency range. What is needed is a way to economically produce the elements and the antenna assembly.

SUMMARY OF THE INVENTION

In view of the foregoing, a multiple dipole element is manufactured from a single sheet of a low loss conducting material. The multiple dipole element may be stamped, punched, cut, or etched and then bent into the proper shape or alternatively die-cast. The multiple dipole element is attached to a reflector plate via a base and feed lines are located along the top and bottom surfaces of the element. The combination of the multiple dipole element and feed lines forms a multiple dipole set of radiation elements.

Several dipoles can be added to the multiple dipole element to achieve different radiation patterns. The dipole elements can also be formed into different shapes to achieve different lobe shapes.

In one embodiment, a tab is located at the center of each feed of the multiple dipole element and is bent at either an upward angle or a downward angle. The tab can be bent at any angle and the tabs attenuate the radiation caused by the slot.

Additional features and advantages of the invention will become more apparent from the following detailed description of illustrative embodiments when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1A:
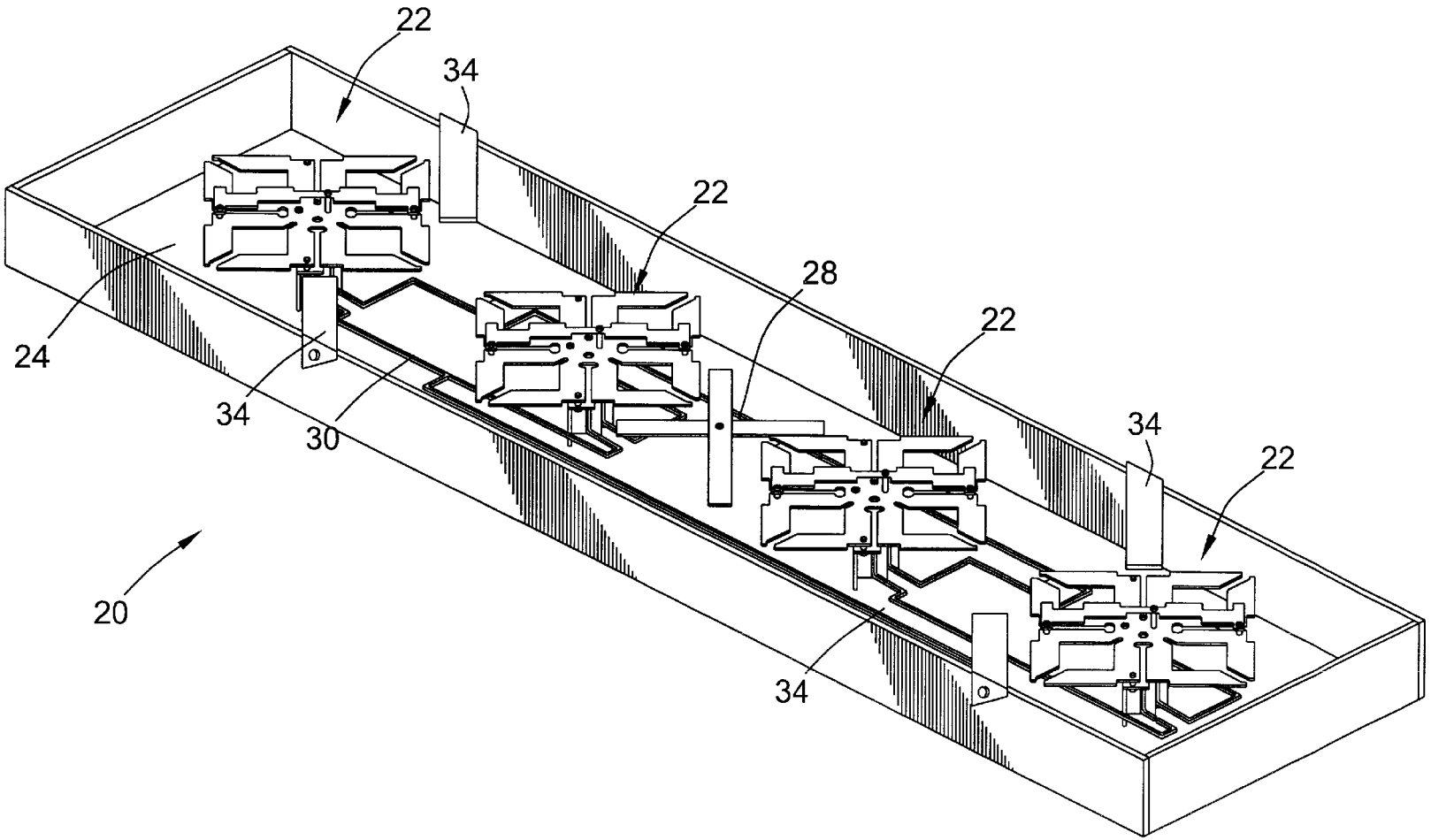
FIG. 1*a* is a perspective view of an antenna system in accordance with the instant invention.
Figure 1B:
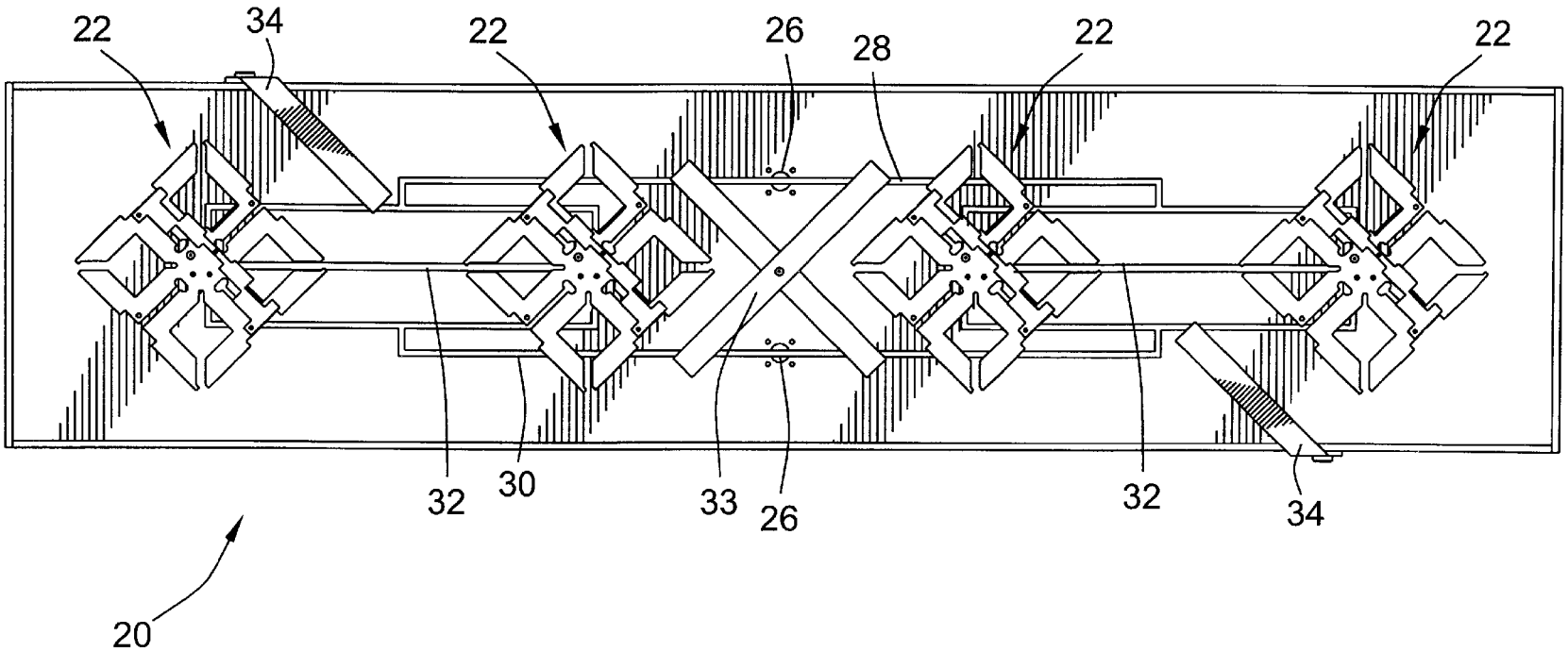
FIG. 1*b* is a top view of the antenna system of FIG. 1*a;*
Figure 1C:
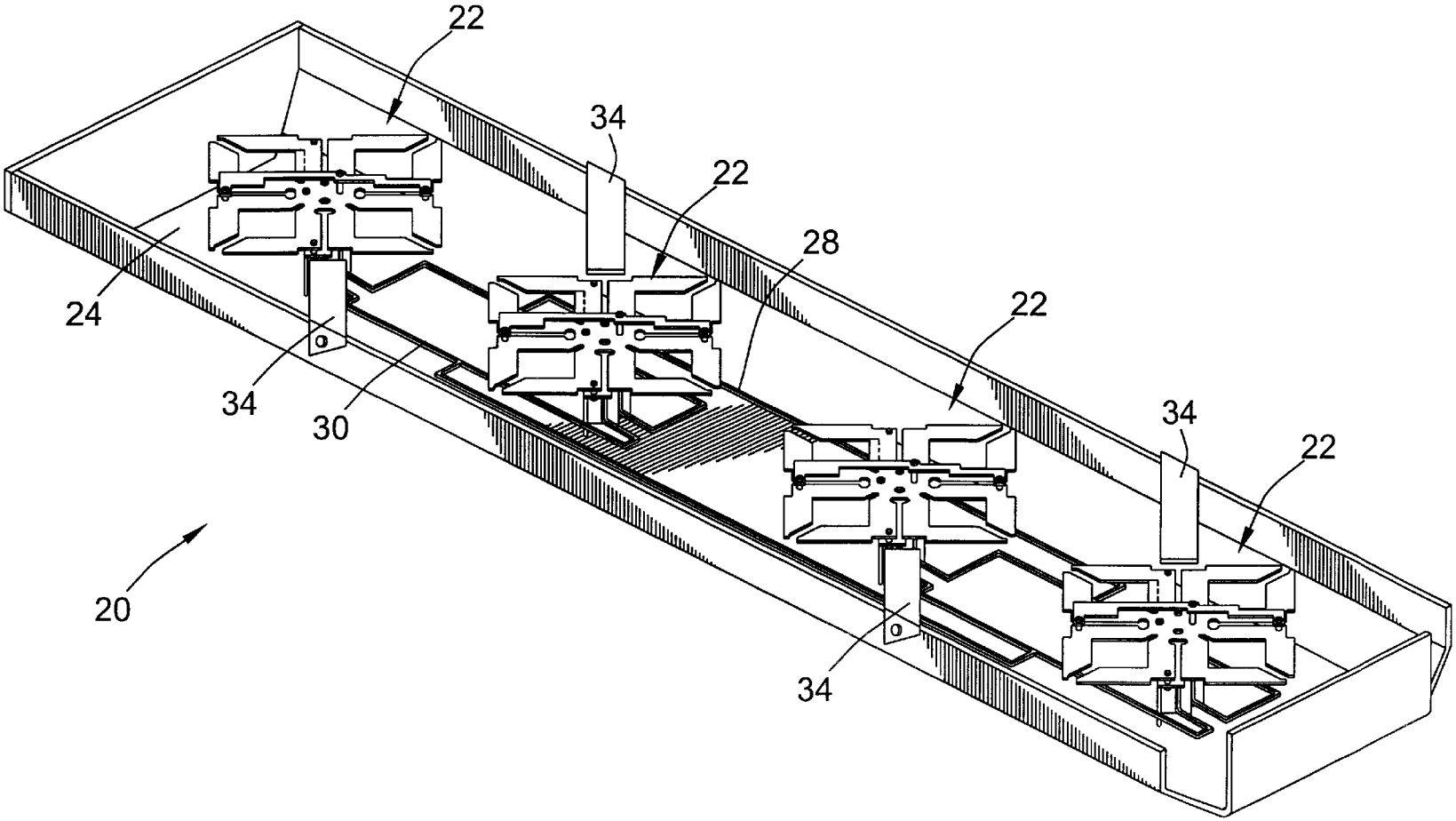
FIG. 1*c* is a perspective view of a further embodiment of an antenna system in accordance with the instant invention.
Figure 1D:
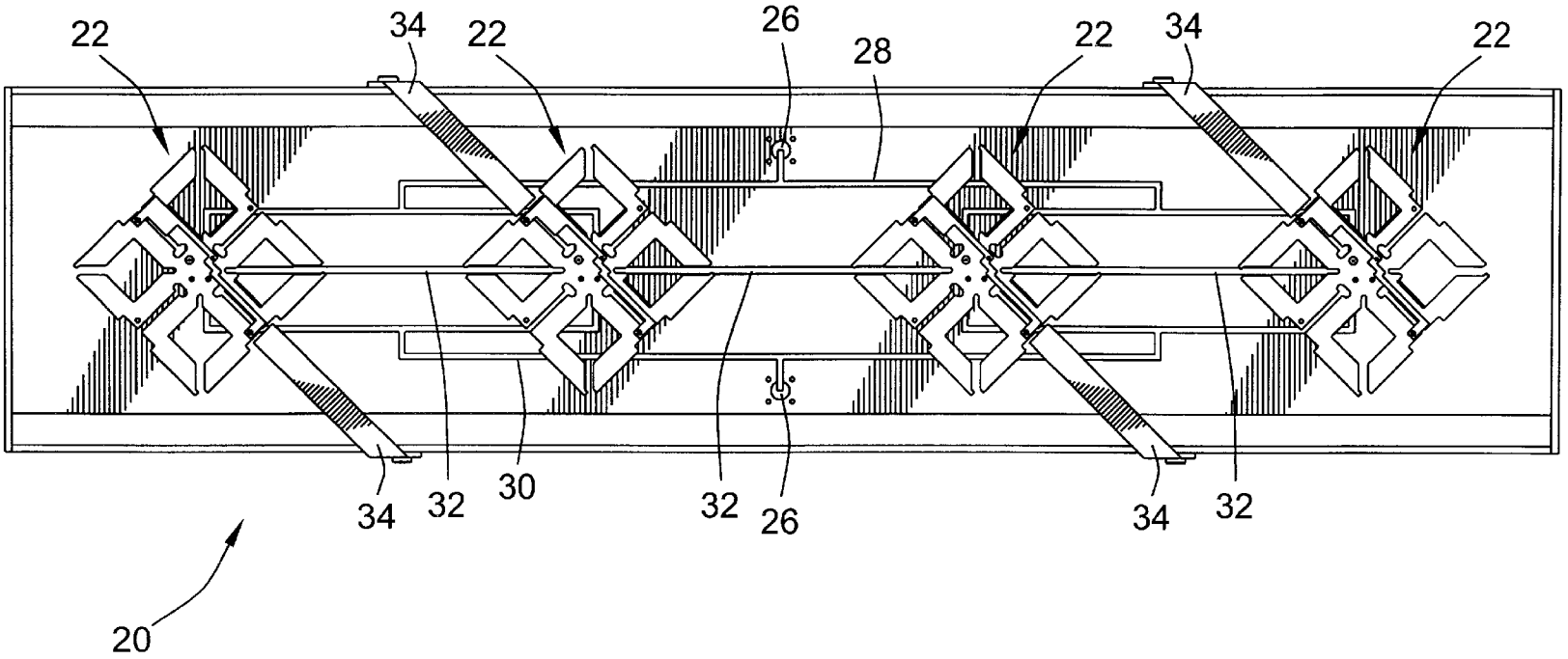
FIG. 1*d* is a top view of the antenna system of FIG. 1*c;*

Turning to the drawings, wherein like reference numerals refer to like elements, the antenna system 20 in FIGS. 1*a* and 1*b* has antenna elements 22 attached to a reflector plate 24, which is typically made from aluminum extrusions or other conducting metal. The antenna elements 22 are connected to connectors 26 via low loss transmission feed lines 28, 30. The transmission feed lines 28, 30 may be brass, aluminum, or any other conducting material and air is used as insulation. The number of antenna elements 22 is selected to achieve different radiation patterns. A cover (not shown) can be removably attached to the reflector plate 24. Each antenna element 22 has a multiple dipole element connected to the reflector plate via mounting bases and at least one feed line portion mounted to the multiple dipole element. FIGS. 1*c* and 1*d* show a further exemplary embodiment of the present invention with different multiple dipole elements and feed line portions.

The antenna element 22 and a portion of the feed lines 28, 30 are made from a flat sheet of material as illustrated in the exemplary embodiments of FIGS. 2*a*–2*e* and FIGS. 3*a* and 3*b*. The multiple dipole element 40 and feed line portion 42 are punched, cut, or etched from low loss conducting material. In one embodiment, the multiple dipole element 40 is made from aluminum and the feed line portion 42 is made from brass. The lengths L, $L_2$ and $L_3$ are chosen to provide adequate bandwidth for the desired frequency band of operation as is known in the art. The multiple dipole element 40 and feed line portion 42 can be formed into any shape to achieve different lobe shapes. The power flow can be adjusted by changing the feed line portion 42 and overall feed line length. For example, the multiple dipole element 40 and feed line portion 42 can be made longer and have a shorter width to operate within a different frequency range.

For purposes of explanation, the multiple dipole element forms a dual polarized antenna with a common support structure. It should be understood that any number of dipole elements may be used. The mounting locations 50 are for mounting a mounting base 112 (see FIGS. 4 to 7). The slot 58 is formed between the dipole elements of the multiple dipole element 40, and in one embodiment is sized to be approximately ¼ wavelength long. The slot 58 increases the isolation between the multiple dipoles. Mounting locations 62 are provided on the multiple dipole element 40. Notches 64 are located along arms 52 and are used to increase the isolation between the dipoles of the antenna system 20. The notches 64 are symmetrical about the center of the multiple dipole element 40. They may be on alternate arms 52 of the multiple dipole element 40 as illustrated or on each of the arms 52. A groove 70 is placed between adjacent edges of the legs 54 and allows the frequency range of operation of the antenna to be expanded to lower frequencies without having to increase the size of the multiple dipole element 40.

The top feed line portion 42 (see FIG. 2*b*) has arm portion 90, leg portions 92 and mounting locations 94. Tabs 91, 93, 95 are located along the arm portion 90. The tabs 91, 93, 95 are used to match the impedances of the feed lines and to make the amplitude and phase of a signal on the top feed-line to match the amplitude and phase of a signal on the bottom feed-line shown in FIG. 2*c*. The bottom feed line portion 42' (see FIG. 2*c*) also has arm portion 90', leg portions 92', mounting locations 94' and tabs 93'.

Figure 2A:
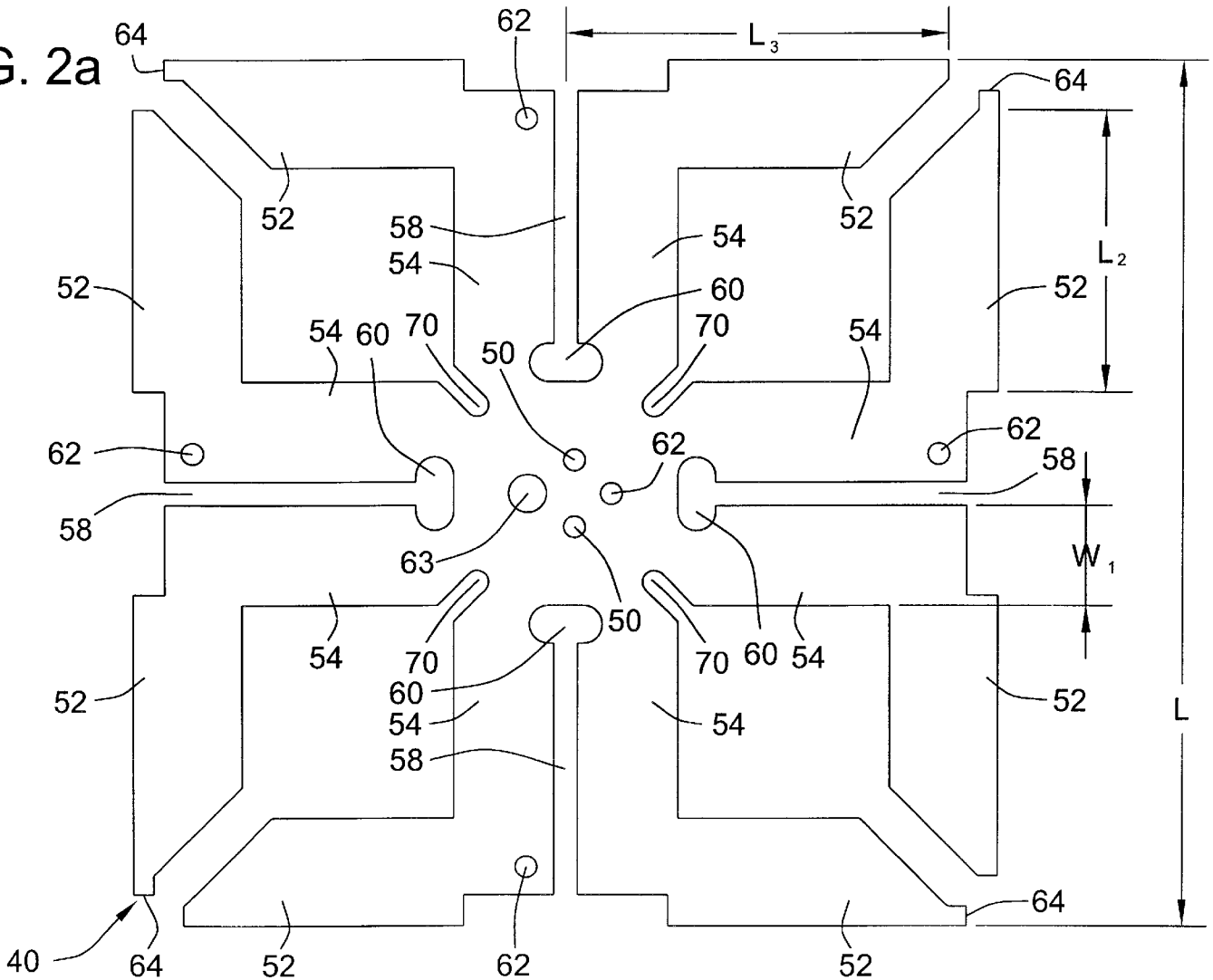
FIG. 2*a* is a plan view of a multiple dipole element according to an exemplary embodiment of the invention.
Figure 2B:
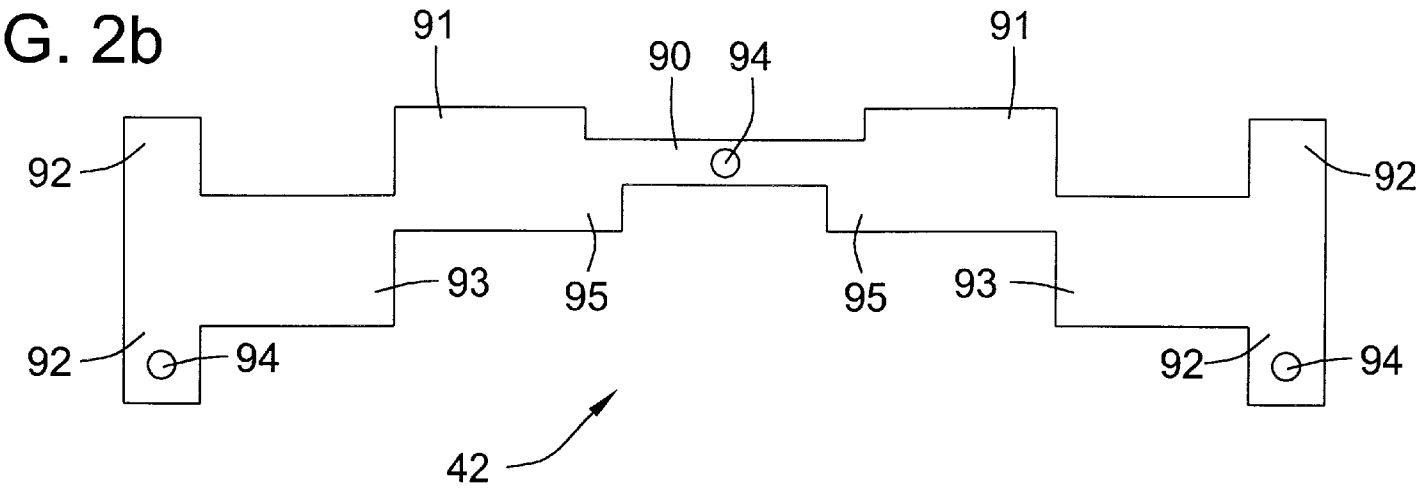
FIG. 2*b* is a plan view of a portion of a top feed line according to an exemplary embodiment of the invention.
Figure 2C:
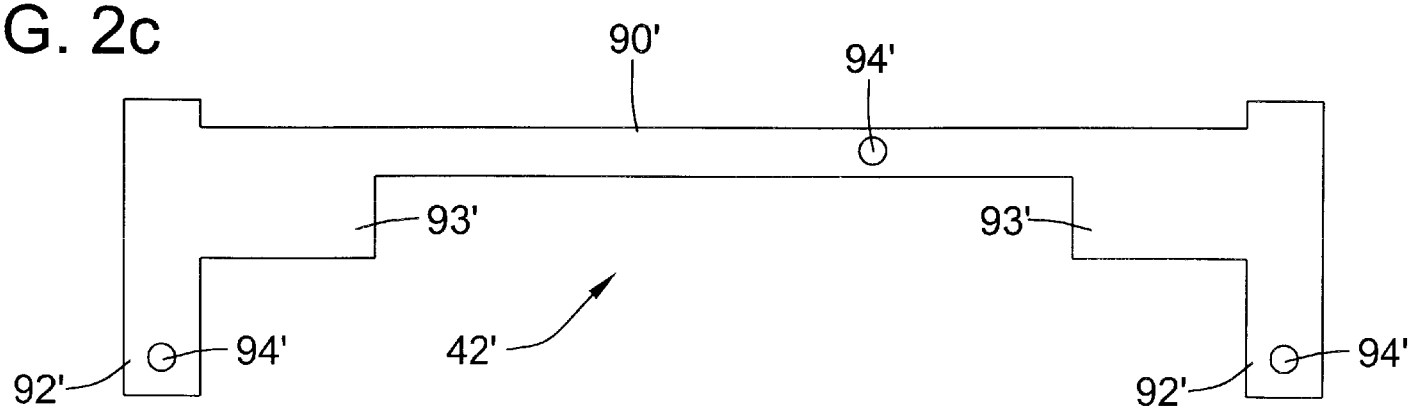
FIG. 2*c* is a plan view of a portion of a bottom feed line according to an exemplary embodiment of the invention.
Figure 2D:
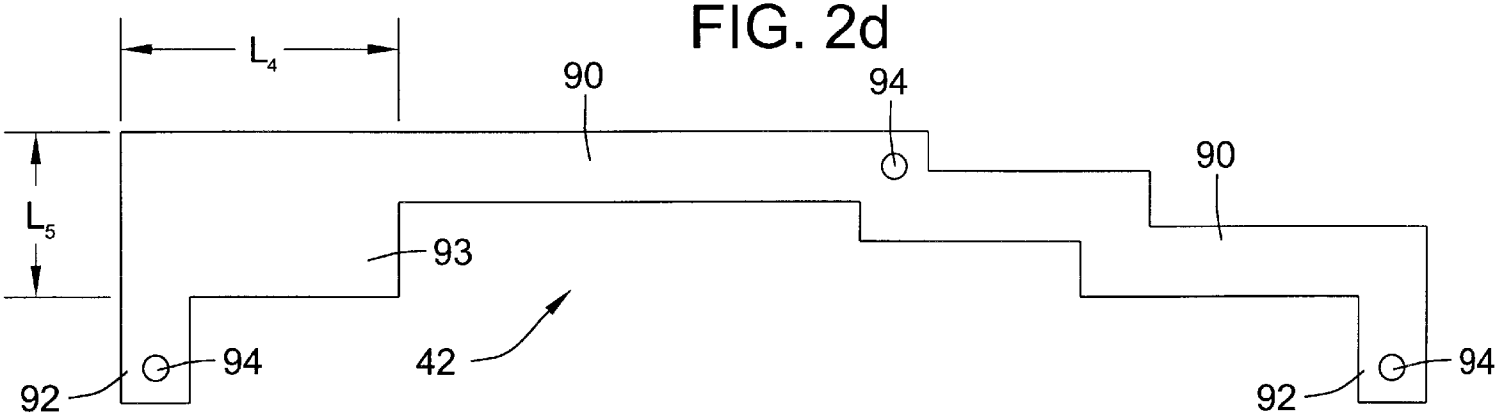
FIG. 2*d* is a plan view of a portion of a feed line according to a further exemplary embodiment of the invention.

An alternate embodiment of the feed line portion is shown in FIG. 2*d*. The feed line portion 42 has arm portion 90, leg portions 92, and mounting locations 94. The feed line portion 42 has a tab portion 93 with a length $L_4$ along the arm portion 90 and a length $L_5$ along the leg portion 92. The purpose of the tab portion 93 is to match the impedances of the feed-lines and to make the amplitude and phase of a signal on one feed-line to match the amplitude and phase of a signal on the other feed-line. Mounting locations 94 are set at a position on the feed line portion 42 such it is aligned with the mounting locations 62 of the multiple dipole element 40.

Figure 2E:
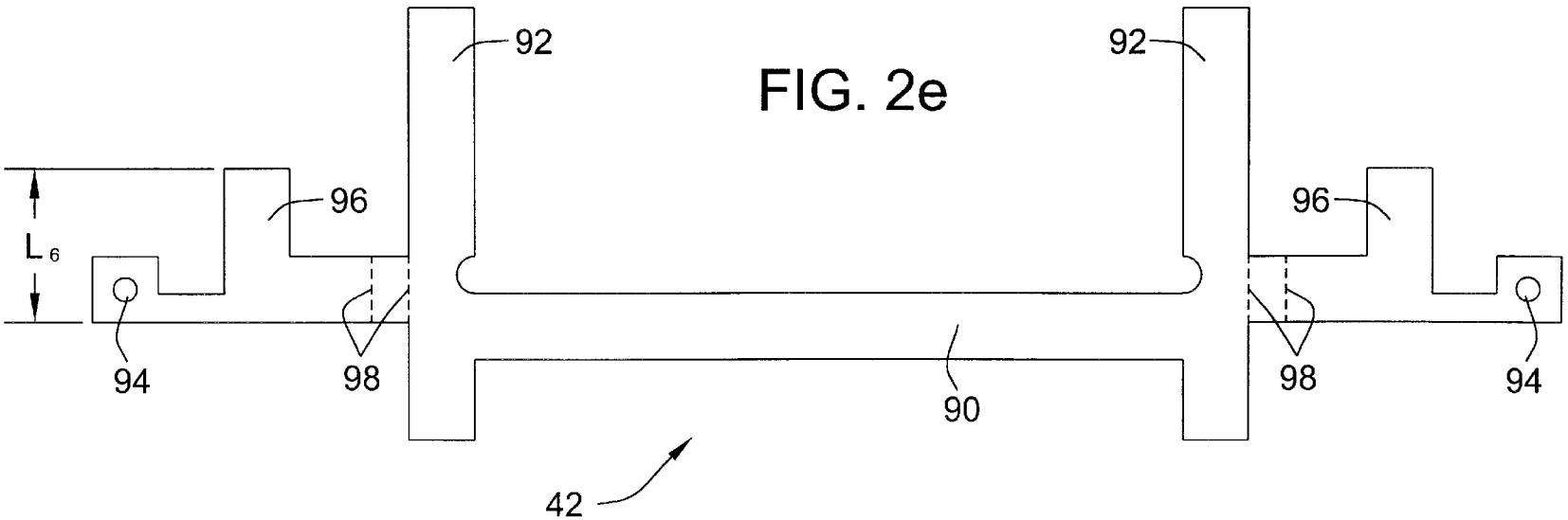
FIG. 2*e* is a plan view of a portion of a feed line of a further exemplary embodiment of the invention.

A further alternate embodiment of a feed line portion 42 is illustrated in FIG. 2*e*. The feed line portion 42 of FIG. 2*e* has arm portion 90, leg portions 92, and mounting location 94 on the arm portion 90. The secondary leg portion 96 has a length $L_6$ and its purpose is to match the impedances of the dipoles. Mounting locations 94 are set at a position on the feed line portion 42 such they are aligned with the mounting locations 62 of the multiple dipole element 40. When mounted on the multiple dipole element 40, the secondary leg portion 96 is attached to the opposite side of the multiple dipole element 40 that the leg portion 92 is mounted. While FIG. 2*e* shows the feed line portion 42 as a single piece, it is recognized that the feed line portion 42 can be made from multiple pieces. For example, the feed line portion 42 can be made of three pieces by making a piece comprising arm portion 90 and leg portions 92 and two pieces of secondary leg portion 96 and then connecting the pieces together at bending locations 98.

In the embodiment shown in FIG. 2*e*, the feed line portions 42 are bent along bending locations 98. After the bending operation, the multiple dipole element 40 and feed line portions 42 are then assembled into an antenna element and installed onto a reflector plate. Alternatively, the multiple dipole element 40 may be installed onto a reflector plate prior to the feed line portion 42 being connected to the multiple dipole element 40.

Figure 3A:
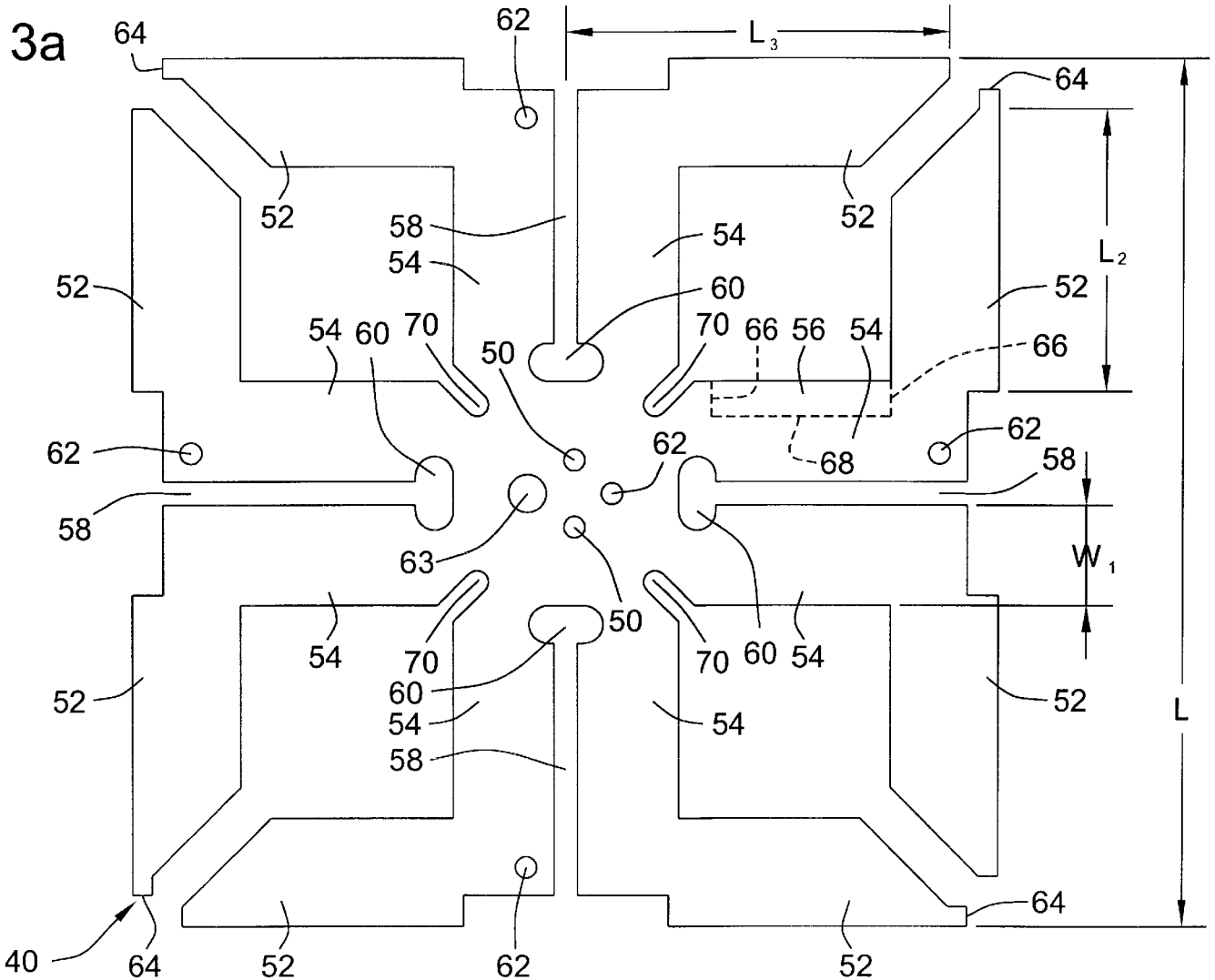
FIG. 3*a* is a plan view of a multiple dipole element according to a further exemplary embodiment of the invention.
Figure 3B:
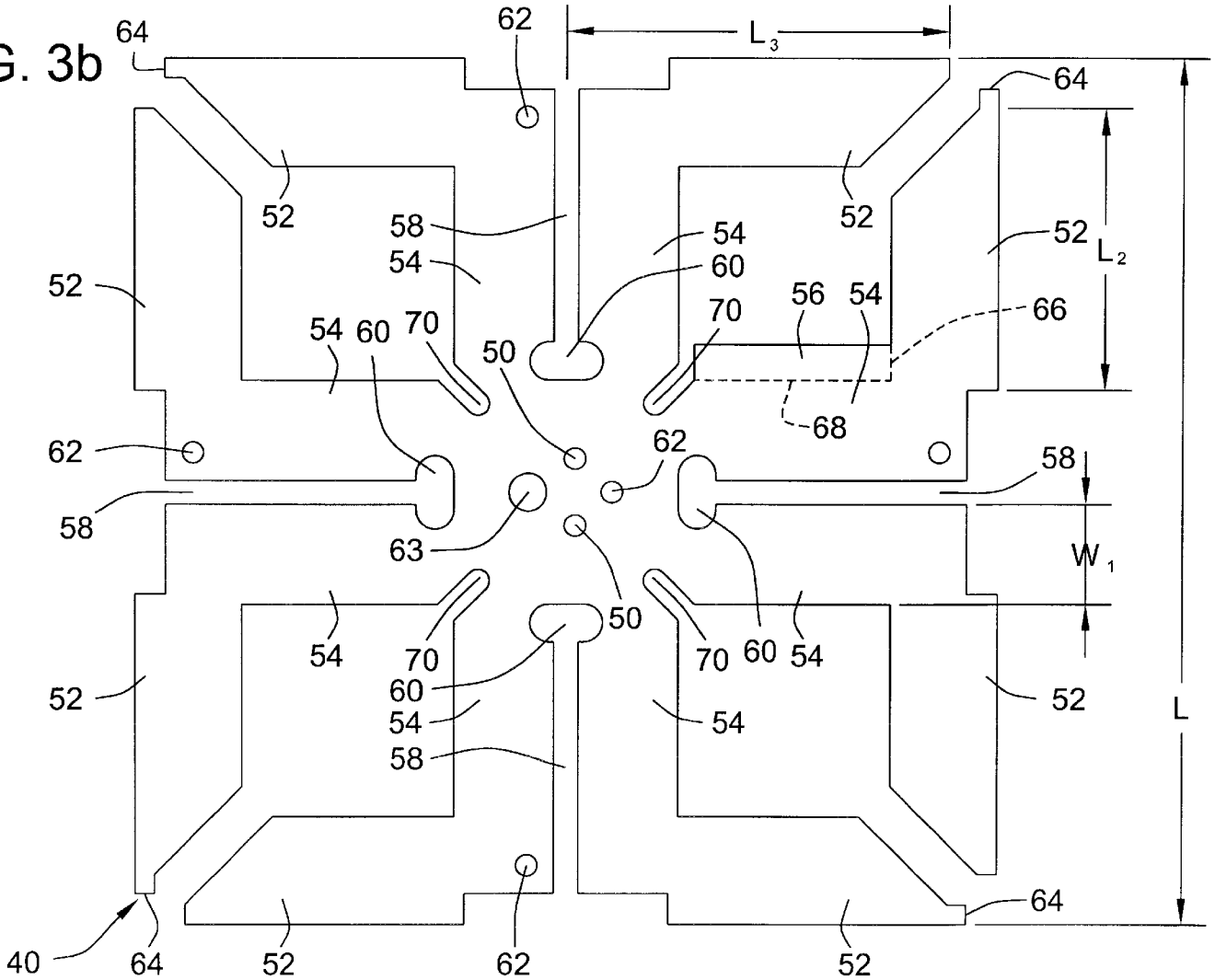
FIG. 3*b* is a plan view of a multiple dipole element according to a further exemplary embodiment of the invention.

An alternate embodiment of the multiple dipole element 40 is shown in FIG. 3*a*. The multiple dipole element 40 has a tab 56 located on one of the legs 54 between an arm 52 and near the edge of an ellipse portion 60 of a slot 58. The tab 56 is bent at approximately a ninety degree angle from the plane of the multiple dipole piece 40. The tab 56 is formed by cutting a section of a leg 54 along lines 66 and bending the tab 56 to the desired angle along line 68. Alternatively, the tab 56 may be formed by adding additional material along one of the legs 54 as illustrated in FIG. 3*b* by cutting along line 66 and bending along line 68. During operation of the antenna system 20, the current flowing around the slot 58 creates a magnetic field that results in the generation of an electromagnetic signal that may interfere with the operation of the antenna system 20. The length of the tab 56 is dependent on the width of the slot and the width $W_1$ and is selected so that the tab interferes with the electromagnetic signal generated at the slot 58, in effect acting like a filter. Additionally, the tab 56 also aids in balancing the impedances of the dipoles of the antenna system 20. In one embodiment, the length is set to approximately one eighth of a wavelength. While the tab is illustrated as being bent at an approximately ninety-degree angle, it should be noted that the tab could be set at any angle.

Figure 4:
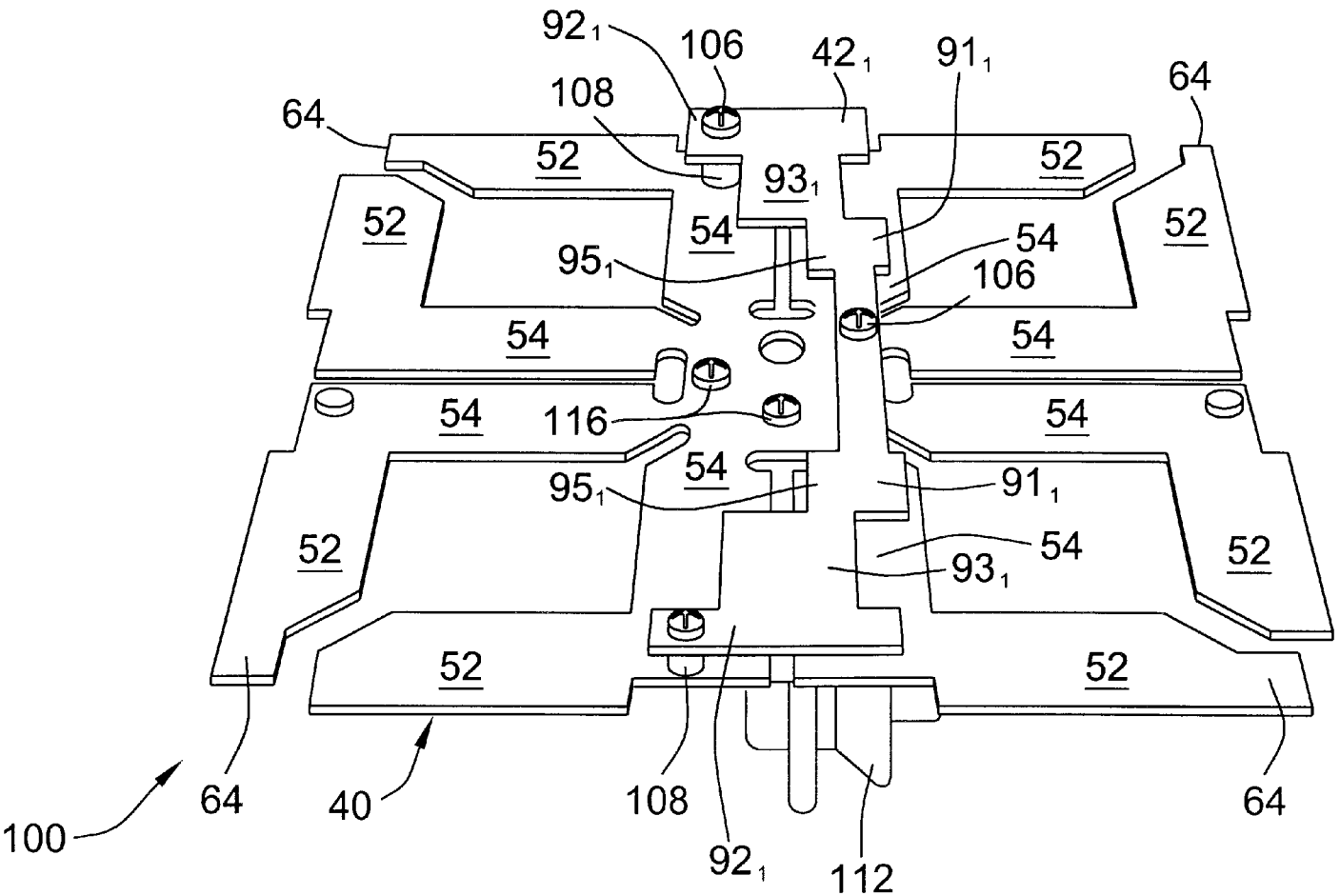
FIG. 4 is a front elevational view of the multiple dipole element and feeder portions of FIGS. 2*a*–2*c;*
Figure 5:
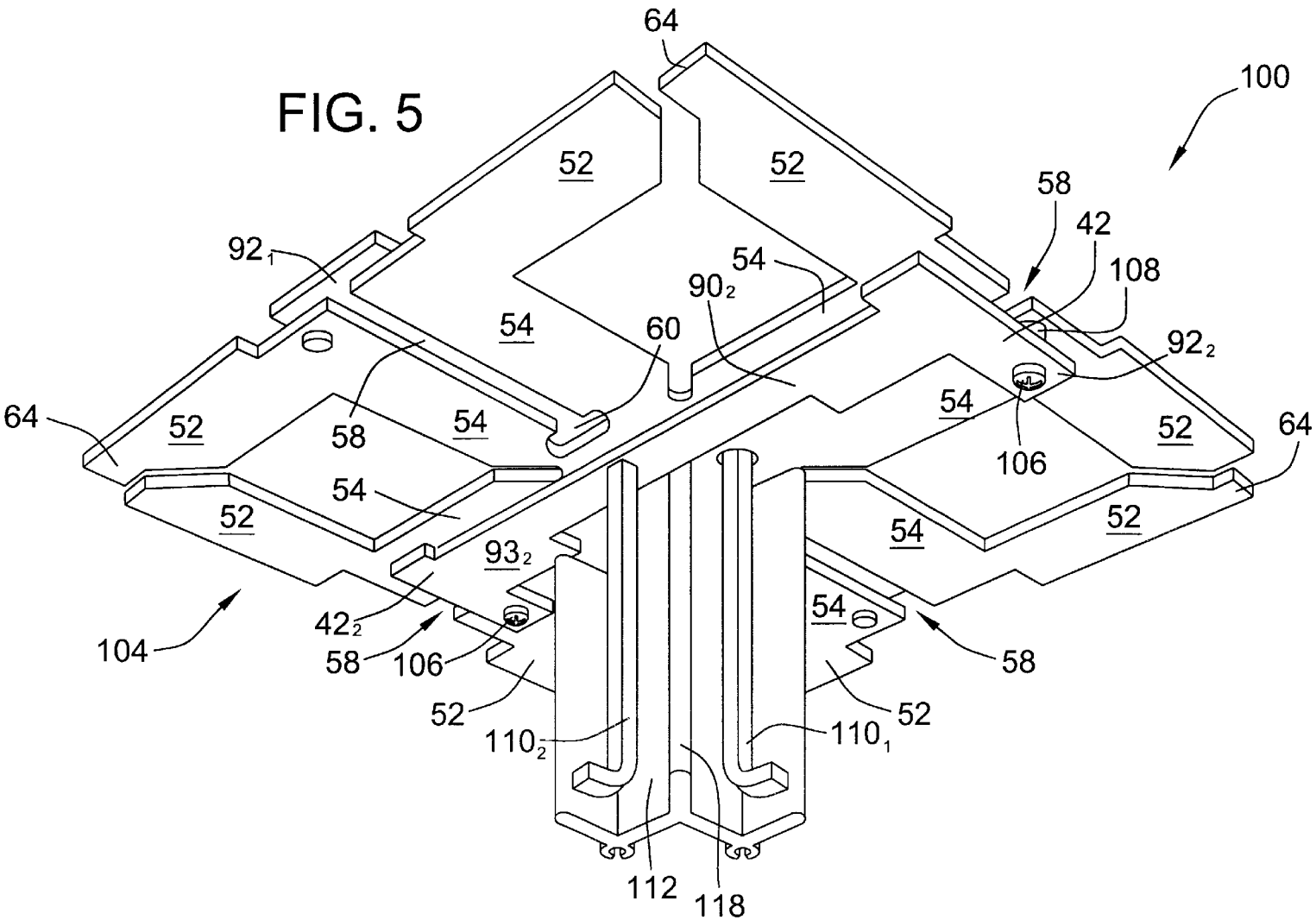
FIG. 5 is a bottom-right perspective view of the multiple dipole element and feeder portions of FIGS. 2*a*–2*c;*
Figure 6:
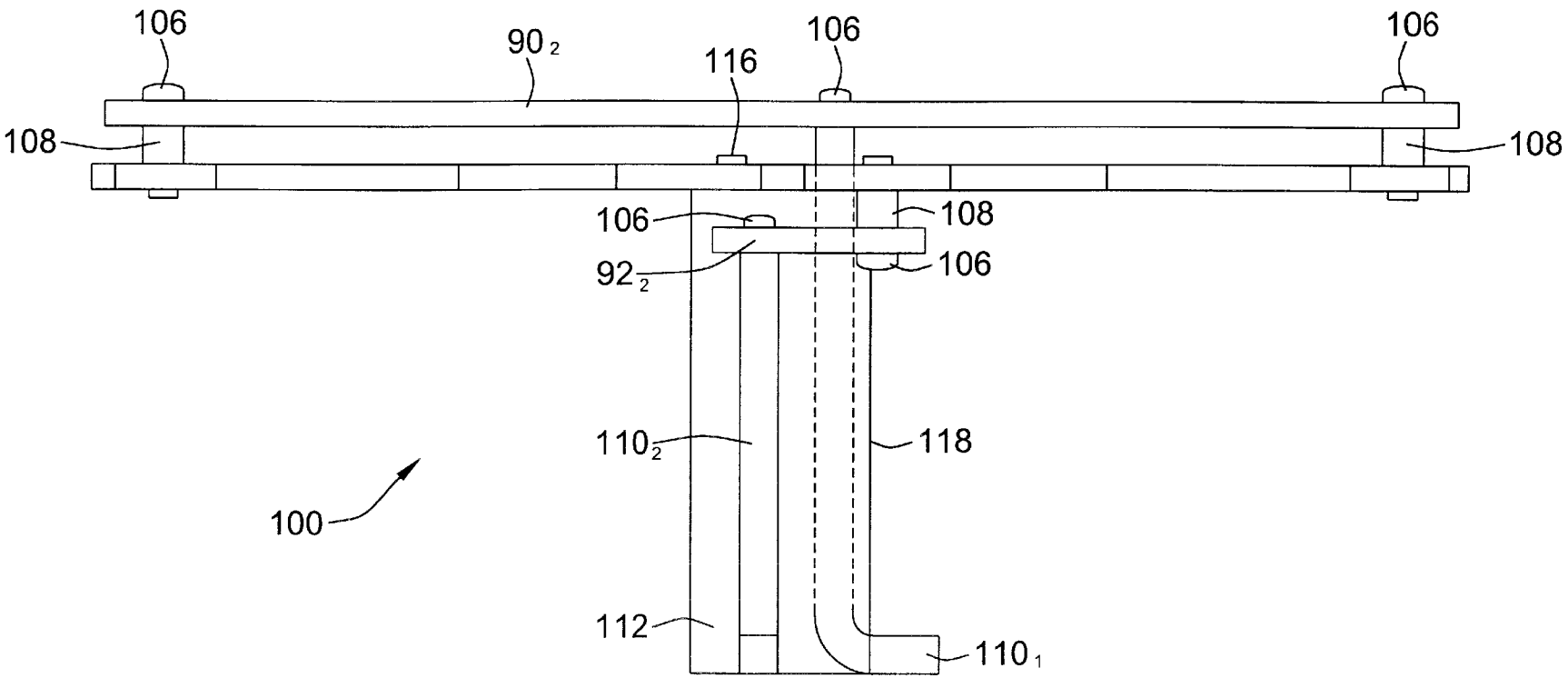
FIG. 6 is a right perspective view of the multiple dipole element and feeder portions of FIGS. 2*a*–2*c;*

An exemplary embodiment of a multiple dipole unit 100 in accordance with the instant invention is shown in FIG. 4 to FIG. 6 prior to installation onto a reflector plate. FIG. 4 is a front elevational view of the multiple dipole unit 100, FIG. 5 is a bottom-right perspective view of the multiple dipole unit 100, and FIG. 6 is a rear-left perspective view of the multiple dipole unit 100. In the description that follows, a feed line portion 42 is located above the top surface 102 of the multiple dipole element 40 and a feed line portion 42 is located below the bottom surface 104 of the multiple dipole element 40. For ease of understanding, the feed line portion 42 located on the top surface and the feed line portion's associated parts shall have a subscript 1 designation (i.e., $\mathbf{42}_1$, $\mathbf{90}_1$, $\mathbf{92}_1$, $\mathbf{94}_1$, etc.). Likewise, the feed line portion 42 located on the bottom surface and the feed line portion's associated parts shall have a subscript 2 designation (i.e., $\mathbf{42}_2$, $\mathbf{90}_2$, $\mathbf{92}_2$, $\mathbf{94}_2$, etc.).

As can be seen, the arm portion $\mathbf{90}_1$ of the feed line portion $\mathbf{42}_1$ is located in parallel to the multiple dipole element 40 above the top surface 102 of the multiple dipole element 40. The feed line portion $\mathbf{42}_1$ is attached to the multiple dipole element 40 on the top surface 102 at mounting location 62. The arm portion $\mathbf{90}_2$ of the feed line portion $\mathbf{42}_2$ is located in parallel to the multiple dipole element 40 underneath the bottom surface 104 of the multiple dipole element 40. The feed line portion $\mathbf{42}_2$ is attached to the multiple dipole element 40 on the bottom surface 102 at mounting locations 62.

In the embodiment shown, the arm portions $90_1$, $90_2$ are connected to the multiple dipole element 40 by screws 106 and are offset by spacers 108. In this embodiment, the multiple dipole element 40 is drilled and tapped at mounting locations 62 and a locator hole is drilled, etched, or punched at mounting locations $94_1$, $94_2$ In other embodiments, the mounting locations $94_1$, $94_2$ can be tapped and a locator hole provided at mounting locations 62. Alternative methods can also be used. For example, a threaded connection of the appropriate length could be provided at either mounting location 62 or mounting location $94_1$, $94_2$ and a locator hole provided at the other mounting location such that the feed line portion $42_1$, $42_2$ may be bolted to the dipole element 40. Additionally, an internally threaded spacer could be provided at one of the mounting locations and a locator hole provided at the other mounting location such that the multiple dipole element 40 and feed line portion $42_1$, $42_2$ are held together by screws.

Each feed line portion 42 has a vertical feed line portion 110 that connects the feed line portion 42 to one of the transmission feed lines 28, 30. For vertical portions 110 that are of insufficient thickness to be held into place, a spacer may be installed between the vertical feed line portion 110 and the mounting base 112 so that the vertical feed line portion 110 is offset from the mounting base 112 at the proper spacing.

The mounting base 112 is connected to the multiple dipole element 40 at mounting locations 50. In the embodiment shown, a locator hole is drilled, etched, or punched at mounting location 50. The mounting base 1 12 has threaded sections 114 that are attached to the multiple dipole element 40 via screw 116. It is recognized that the mounting support can be attached to the multiple dipole element 40 using other methods such as bonding, brazing, soldering, etc. The mounting base 112 has a vertical separator 118. The mounting base 112 is attached to the multiple dipole element 40 such that the vertical feed line portions $110_1$, $110_2$ are separated by the vertical separator 118. The vertical separator 118 prevents cross-talk occurring between the vertical feed line portions $110_1$, $110_2$ and helps balance the impedances of the vertical feed line portions $110_1$, $110_2$.

Figure 7:
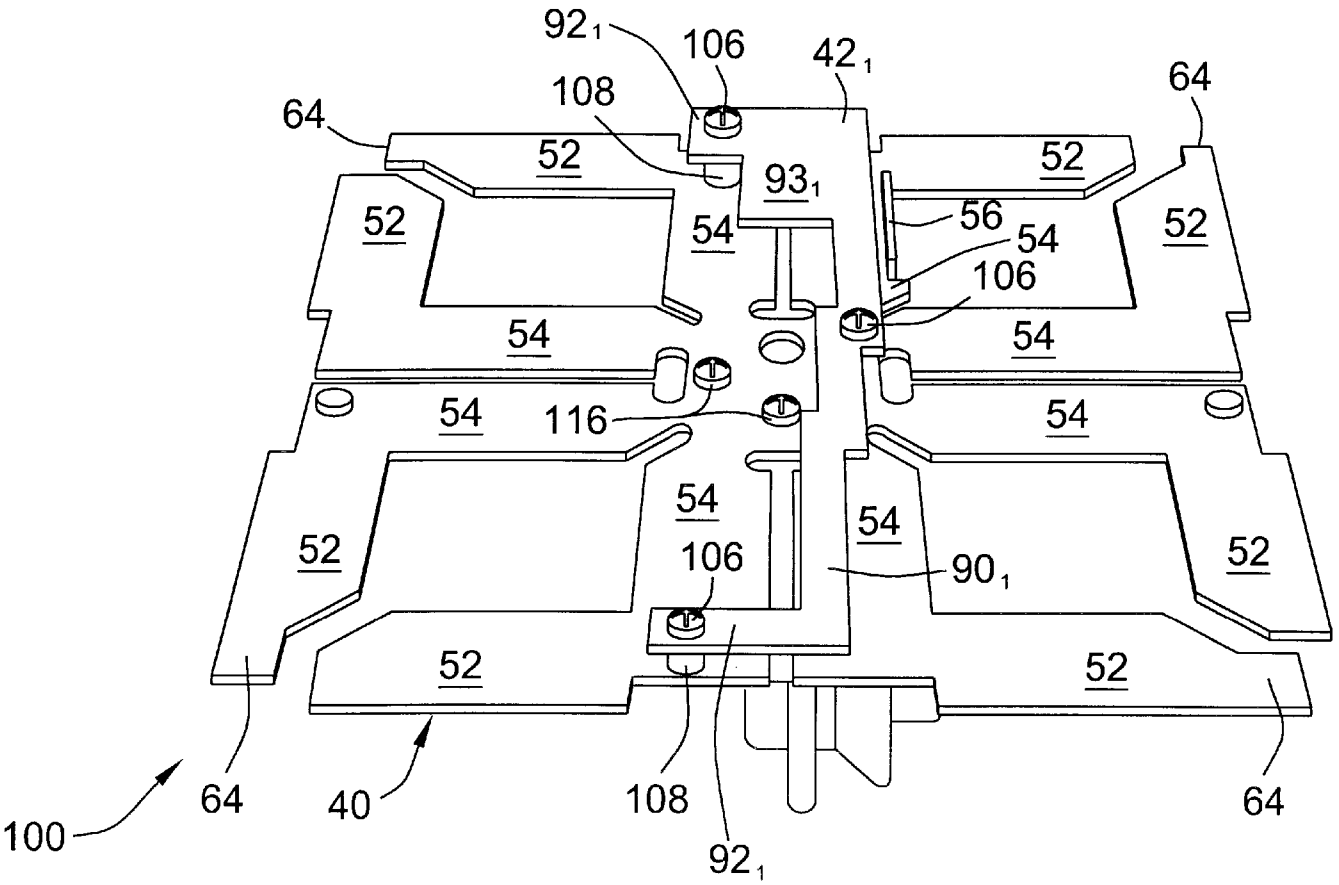
FIG. 7 is a front elevational view of the multiple dipole element and feeder portions of FIG. 2*a* and FIG. 2*d;*
Figure 8:
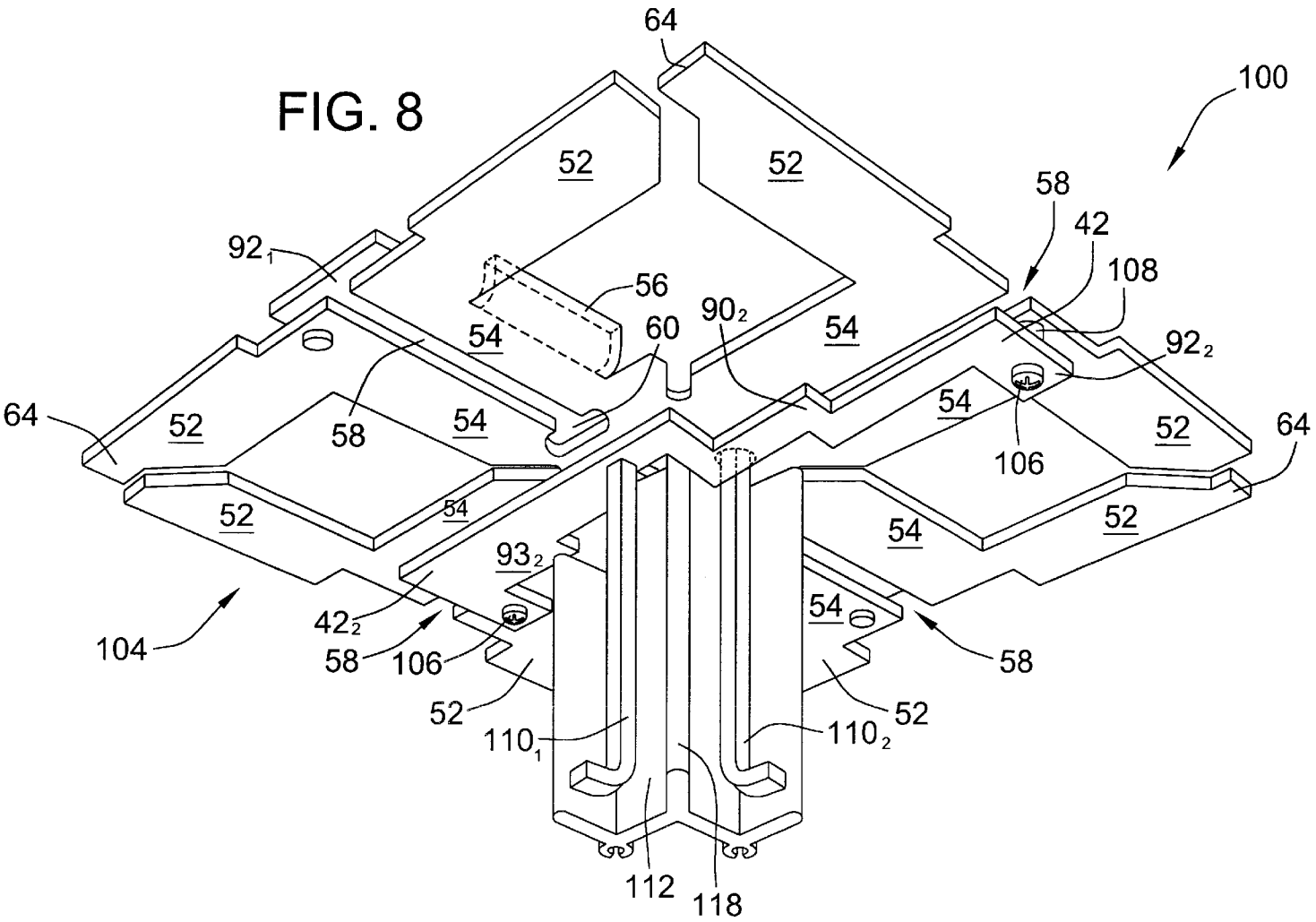
FIG. 8 is a bottom-right perspective view of the multiple dipole element and feeder portions of FIG. 2*a* and FIG. 2*d;*
Figure 9:
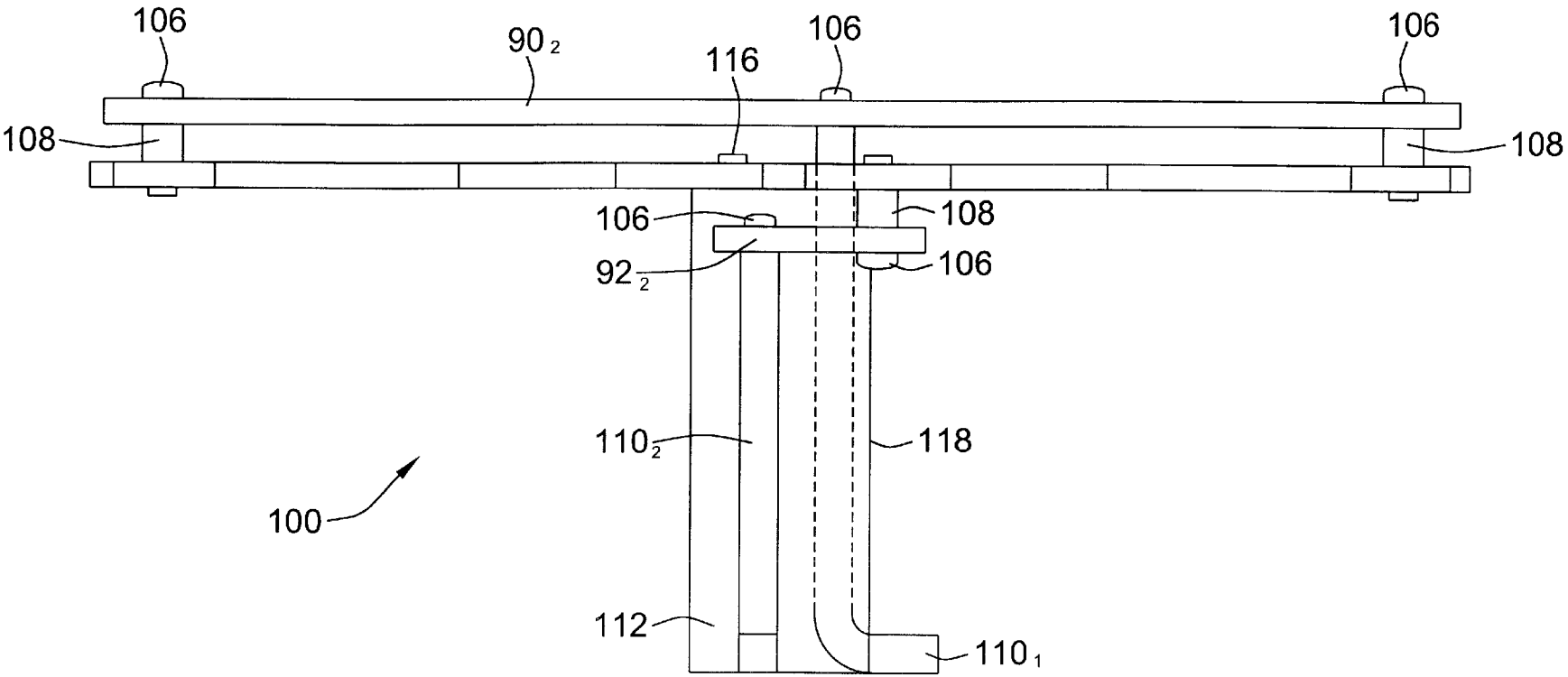
FIG. 9 is a right perspective view of the multiple dipole element and feeder portions of FIG. 2*a* and FIG. 2*d*.

An alternate embodiment of the multiple dipole unit 100 in accordance with the instant invention is shown in FIG. 7 to FIG. 9 prior to installation onto a reflector plate. These figures illustrate a multiple dipole unit incorporating the tab 56 of FIG. 3*a* and the feed line element 42 of FIG. 2*d*. Other embodiments (not shown) can be made using the multiple dipole element of FIG. 3*b* and the feed line portion 42 of FIG. 2*e*.

Figure 10:
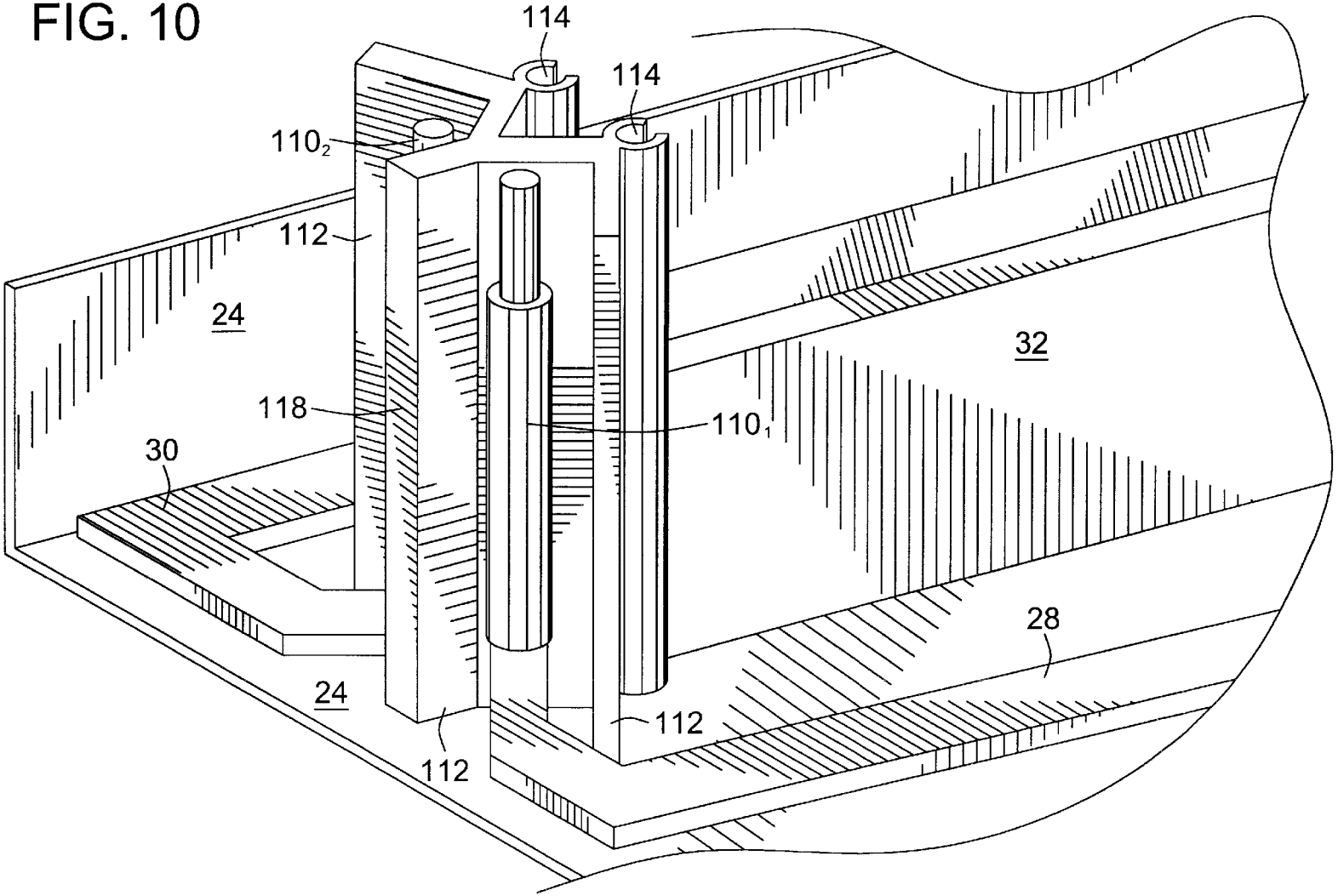
FIG. 10 is a perspective view of a section of the multiple dipole support element and feed line portions of FIGS. 2*a* to 2*c* installed in the antenna system of FIGS. 1*a* and 1*b*.

Referring now to FIGS. 1 and 10, the antenna elements 22 are shown installed on the reflector plate 24. The mounting base 112 of the multiple dipole element 40 is connected to the reflector plate 24 by any suitable means. In the exemplary embodiment shown, the mounting base 112 has threaded portion 114 and is connected to the reflector plate 24 via screws (not shown). In other embodiments, it could be welded, bonded, glued, riveted, etc. The vertical feed line portion $110_1$ is connected to the transmission feed line 28 by soldering, welding, or other suitable means. Likewise, the vertical feed line portion $110_2$ is connected to the transmission feed line 30 by soldering, welding, or other suitable means. An isolation element 32 (see FIG. 1*b*) is placed between the mounting bases of the antenna element 22 to further isolate the feed lines 28, 30. Additionally, the element 33 also isolate the feed lines 28, 30 and increase the isolation between pairs of antenna elements 22. The strips 34 are attached to the reflector plate 24 at a location that provide a right angle to the arms 52 and form a symmetrical axis around the center of antenna elements 22. The strips 34 are located in a the same elevation or in a different elevation from the multiple dipole element and are mounted via screws, bonding, soldering, brazing, etc. The strips 34 increases the isolation between transmission feed lines 28,30.

As previously mentioned, the multiple dipole element 40 and feed line portion 42 may be made of any shape or form to achieve different radiation patterns. The feed line portion 42 can also be configured to change the power flow to the multiple dipole element 40. For example, the arm portion 90 may be shaped so that power flow is unequal between the arms 52. The number of arms 52 and tabs and the corresponding feed line portion 42 can also be increased both vertically and horizontally to increase the gain or change the lobe, lobe rate, or radiation pattern of the antenna. For example, FIG. 1 shows the multiple dipole element and feed line portion of FIG. 4 in a four unit antenna configuration. The feed line portion 42 is routed to account for the phase lag that results from the length of the multiple dipole element and feed line portion.

When installed, the antenna can be configured in several configurations. For example, if the antenna element 22 shown in the exemplary embodiment is placed at a position such that one of the feed line portions 42 is at a zero degree (i.e., in the elevation plane at $\Phi=0$) and the other feed line portion is at a 90 degree orientation, the antenna system forms a dual linear ±90 degree horizontally or vertically polarized antenna. In another embodiment, the antenna element 22 is rotated forty five degrees. As a result the antenna system forms a dual linear ±45 degree horizontally or vertically polarized antenna. Additionally, a circularly polarized antenna can also be formed by combining the signals on the transmission feed lines of the ±90 degree horizontally or vertically polarized antenna through a 90 degree combiner hybrid as known by those skilled in the art.

The foregoing description of various preferred embodiments of the invention has been presented for purposes of illustration and description. It is not intended to be exhaustive or to limit the invention to the precise forms disclosed. Obvious modifications or variations are possible in light of the above teachings. For example, the multiple dipole element 40 and feed line portion 42 may be die-cast. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A dual polarized antenna system having an electrically conductive reflector plate comprising:

at least one multiple dipole element having a top surface and a bottom surface, the multiple dipole element formed from a single piece of electrically conductive material forming a plurality of half-wave dipole elements separated by slots, the multiple dipole element having at least two legs separated by one of the slots and at least one arm integrally attached to each leg at a position substantially normal to the leg;

a base attached to the multiple dipole element and attached to the reflector plate; and a plurality of feed lines connected to the multiple dipole element, a first feed line of the plurality of feed lines is placed above the top surface and a second feed line of the plurality of feed lines is placed below the bottom surface at a position normal to the first feed line.

2. The antenna system of claim 1 wherein the reflector plate has a length and a width, the base is attached to the reflector plate such that one of the first feed line and second feed line is located along a first axis, the first axis being in parallel with a second axis located along the length thereby forming a ±ninety degree polarized antenna system.

3. The antenna system of claim 1 wherein the reflector plate has a length and a width, the base is attached to the reflector plate such that one of the first feed line and second feed line is located along a first axis, the first axis being at a forty five degree angle relative to a second axis located along the length thereby forming a ±forty five degree polarized antenna system.

4. The antenna system of claim 1 further having at least one tab integral with a leg and located between an arm and a groove, the groove located at a junction between adjacent legs.

5. The antenna system of claim 4 wherein the tab is located at a predefined angle selected from one of forty-five degrees and ninety degrees.

6. The antenna system of claim 1 wherein the antenna system has a plurality of multiple dipole elements and bases and further comprises an isolation element attached to the reflector plate and located between the bases, the horizontal feed line portions of the feed lines connected to the first feed elements are routed above the reflector plate on a first side of the isolation element and the horizontal feed line portions of the feed lines connected to the second feed elements are routed on a second side of the isolation element.

7. A dual polarized antenna system having an electrically conductive reflector plate comprising:

at least one multiple dipole element having a top surface and a bottom surface, the multiple dipole element formed from a single piece of electrically conductive material forming a plurality of half-wave dipole elements separated by slots, the multiple dipole element comprising:

at least two legs separated by one of the slots;

at least one arm integrally attached to each leg at a position substantially normal to the leg;

at least one notch integrally attached to at least one of the arms;

a base having at least one feeder line channel, the base attached to the multiple dipole element and attached to the reflector plate;

a plurality of feed elements connected to the multiple dipole element, a first feed element of the plurality of feed elements is placed above the top surface and a second feed element of the plurality of feed elements is placed below the bottom surface at a position substantially normal to the first feed element; and a plurality of feed lines, each feed line having a vertical feed line portion connected to one of the feed elements and a horizontal feed line portion connected to at least one connector, each vertical feed line portion located in one of the feeder line channels and each horizontal feed line portion located above the reflector plate.

8. The antenna system of claim 7 wherein the reflector plate has a length and a width, the base is attached to the reflector plate such that one of the first feed element and second feed element is located along a first axis, the first axis being in parallel with a second axis located along the length thereby forming a ±ninety degree polarized antenna system.

9. The antenna system of claim 8 wherein the reflector plate has a length and a width, the base is attached to the reflector plate such that one of the first feed element and second feed element is located along a first axis, the first axis being at a forty five degree angle relative to a second axis located along the length thereby forming a ±forty five degree polarized antenna system.

10. The antenna system of claim 7 wherein each horizontal feed line portion has an impedance from the connector to a multiple dipole element and each horizontal feed line portion is routed so that the impedance of a first horizontal feed line portion is approximately matched to the impedance of a second horizontal feed line portion at a desired frequency range.

11. The antenna system of claim 7 wherein the multiple dipole element is located in a first elevation, the antenna system further comprising at least one strip attached to the reflector plate, the strip attached to the reflector plate at a location such that the strip is at an approximately ninety degree angle from one of the arms at a predefined distance from one of the arms at a second elevation and centered on an axis of the slot.

12. The antenna system of claim 11 wherein a plurality of strips form a symmetrical axis around the center of a pair of multiple dipole elements.

13. The antenna system of claim 7 wherein the multiple dipole element further comprises at least one tab integral to one of the legs and located between an arm and a groove, the groove located at a junction between adjacent legs.

14. The antenna system of claim 7 wherein the antenna system has a plurality of multiple dipole elements and bases and further comprises an isolation element attached to the reflector plate and located between the bases.

15. The antenna system of claim 14 wherein the horizontal feed line portions of the feed lines connected to the first feed elements are routed above the reflector plate on a first side of the isolation element and the horizontal feed line portions of the feed lines connected to the second feed elements are routed on a second side of the isolation element.

16. A multiple dipole element having a top surface and a bottom surface formed from a single piece of electrically conductive material comprising:

a plurality of legs, the legs separated by slots and grooves, each leg substantially parallel to at least one other leg and approximately normal to an adjacent leg;

at least one arm integrally attached to at least one of the legs at a position substantially normal to the leg, the plurality of legs and the at least one arm unitarily formed from the single piece of electrically conductive material; and at least one tab located along one of the legs between one of the arms and an adjacent leg, the at least one tab integrally formed with the one of the legs.

17. The multiple dipole element of claim 16 further comprising at least one notch integrally attached to one of the arms.

18. The multiple dipole element of claim 17 wherein the multiple dipole element has a plurality of arms and half of the plurality of arms have notches.

19. The multiple dipole element of claim 18 wherein the arms having notches are symmetrically located about a center of the multiple dipole element.

20. The multiple dipole element of claim 16 wherein the tab is substantially normal to the plurality of legs.

* * * * *